US006565916B2

(12) United States Patent
Hayashida et al.

(10) Patent No.: US 6,565,916 B2
(45) Date of Patent: May 20, 2003

(54) METHOD FOR PRODUCING OXIDE CATHODE

(75) Inventors: Yoshiki Hayashida, Osaka (JP); Yoshikazu Iwai, Osaka (JP); Shinji Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/788,835

(22) Filed: Feb. 20, 2001

(65) Prior Publication Data

US 2001/0016228 A1 Aug. 23, 2001

(30) Foreign Application Priority Data

Feb. 21, 2000 (JP) ..... 2000-042273

(51) Int. Cl.[7] ..... B05D 5/12; B05D 3/12

(52) U.S. Cl. ..... 427/77; 427/78; 427/126.3; 427/359; 427/360

(58) Field of Search ..... 427/64, 68, 77, 427/78, 359, 360, 383.1, 126.3; 313/346 R, 346 DC, 446

(56) References Cited

U.S. PATENT DOCUMENTS 3,722,045 A * 3/1973 Buescher ..... 29/25.17
4,958,001 A 9/1990 Kikuchi et al.
5,122,707 A 6/1992 Nakanishi et al.
5,216,320 A * 6/1993 Koizumi et al. ..... 313/346 R
5,548,184 A * 8/1996 Choi et al. ..... 313/346 R
5,925,976 A * 7/1999 Hayashida et al. ..... 313/346 R

FOREIGN PATENT DOCUMENTS

| | | |
|---|---|---|
| JP | 1-197934 | 8/1989 |
| JP | 5-74324 | 3/1993 |
| JP | 11-102636 | 4/1999 |

* cited by examiner

*Primary Examiner*—Brian K. Talbot
(74) *Attorney, Agent, or Firm*—Merchant & Gould P.C.

(57) ABSTRACT

A method for producing an oxide cathode including a sleeve containing a heater coil, a cathode substrate provided on one end of the sleeve, and an emissive material layer formed by thermally decomposing an alkaline earth metal carbonate layer adhered onto the cathode substrate, which method includes adhering the alkaline earth metal carbonate onto the cathode substrate so that it has a bulk density of 0.5 to 0.8 g/cm$^3$, then pressing it so that the bulk density becomes not more than 0.9 g/cm$^3$, and then thermally decomposing it in vacuum. Accordingly, an oxide cathode in which the current density distribution of emission electrons is smooth and an electron emission characteristic is not deteriorated when operated for a long time is realized, and a method for producing a cathode-ray tube with high resolution in which moire is invisible is provided.

10 Claims, 8 Drawing Sheets

METHOD FOR PRODUCING OXIDE CATHODE

FIELD OF THE INVENTION

The present invention relates to a cathode of a cathode-ray tube used for a display such as a television receiver or computer monitor, particularly to a method for producing an oxide cathode including a specific emissive material layer.

BACKGROUND OF THE INVENTION

FIG. 8 illustrates an oxide cathode in which a porous emissive material layer 9 is formed on a cathode substrate 3 on one end of a sleeve 2 containing a heater coil 1, which is known widely as a cathode of a cathode-ray tube. JP 5(1993)-74324A discloses one conventional example of such an oxide cathode, in which an emissive material layer is separated into an upper layer (surface side) and a lower layer (substrate side), and the particle size of the emissive material in the upper layer is made smaller than that of the emissive material in the lower layer. Accordingly, the surface roughness of the emissive material layer can be decreased to improve flatness, so that the angle of thermionic emission (emittance) can be decreased, and distortion of the current density distribution of emission electrons can be eliminated. Thus, a cathode-ray tube with excellent resolution can be realized.

However, in this case, as the particle size of the upper layer of the emissive material layer is smaller than that of the lower layer, because the particles forming the upper layer are fine, its bulk density is increased, and its porous structure is lost easily. Thus, the electron emission characteristic of the cathode is reduced easily when the cathode-ray tube is operated for a long time.

SUMMARY OF THE INVENTION

It is an object of the present invention to provide a method for producing an oxide cathode including a specific emissive material layer with high resolution, without deterioration of the electron emission characteristic of the cathode when operated for a long time.

To solve the above problem, the present invention provides a method for producing an oxide cathode including a sleeve containing a heater coil, a cathode substrate provided on one end of the sleeve, and an emissive material layer formed by thermally decomposing an alkaline earth metal carbonate layer adhered onto the cathode substrate, which method includes: adhering the alkaline earth metal carbonate onto the cathode substrate so that the alkaline earth metal carbonate has a bulk density of at least 0.5 g/cm$^3$ but not more than 0.8 g/cm$^3$; then pressing the alkaline earth metal carbonate so that the bulk density becomes not more than 0.9 g/cm$^3$, thereby forming the carbonate layer; and then thermally decomposing the carbonate layer in vacuum.

According to the method of the present invention, the flatness of the surface of the emissive material layer can be improved without damaging its porous structure.

In the method of the present invention, it is preferable that the pressure of the pressing is at least $1.5\times10^5$ Pa but not more than $3.5\times10^5$ Pa. Accordingly, the bulk density and the surface roughness of the emissive material layer can be optimized.

In the method of the present invention, it is preferable that the thickness of the carbonate layer after the pressing is at least 40 $\mu$m but not more than 90 $\mu$m. Accordingly, a decrease in the emission current of the oxide electrode can be inhibited, while the emissive material layer can be prevented from peeling.

In the method of the present invention, it is preferable that the surface roughness of the carbonate layer after the pressing is not more than 13 $\mu$m. Accordingly, distortion of the current density of emission electrons can be eliminated.

Furthermore, it is preferable that the alkaline earth metal carbonate has an average particle size of at least 2 $\mu$m and a maximum particle size of not more than 13 $\mu$m. Accordingly, the porosity of the emissive material can be maintained.

In the method of the present invention, it is preferable that the bulk density of the carbonate layer after the pressing is at least 0.6 g/cm$^3$ but not more than 0.9 g/cm$^3$.

Furthermore, it is preferable that the thermal decomposition is carried out at a temperature of 900 to 1000° C.

Furthermore, it is preferable that the thermal decomposition is carried out at a pressure of $1\times10^{-6}$ to $1\times10^{-2}$ Pa.

Accordingly, a cathode-ray tube with excellent resolution in which moire is invisible or hardly visible can be realized.

In the present invention, it is preferable that the ratio of remaining emission current after being operated for 2000 hours at a temperature of the emissive material layer of 850° C. with an emission current density of 2 A/cm$^2$ is at least 80%, when considering the initial value as 100%.

In the present invention, it is preferable that the alkaline earth metal carbonate is a binary carbonate of barium and strontium or a ternary carbonate of barium, strontium and calcium.

PREFERRED EMBODIMENT OF THE INVENTION

In the following, an embodiment of the present invention is described with reference to the accompanied drawings.

Figure 1:
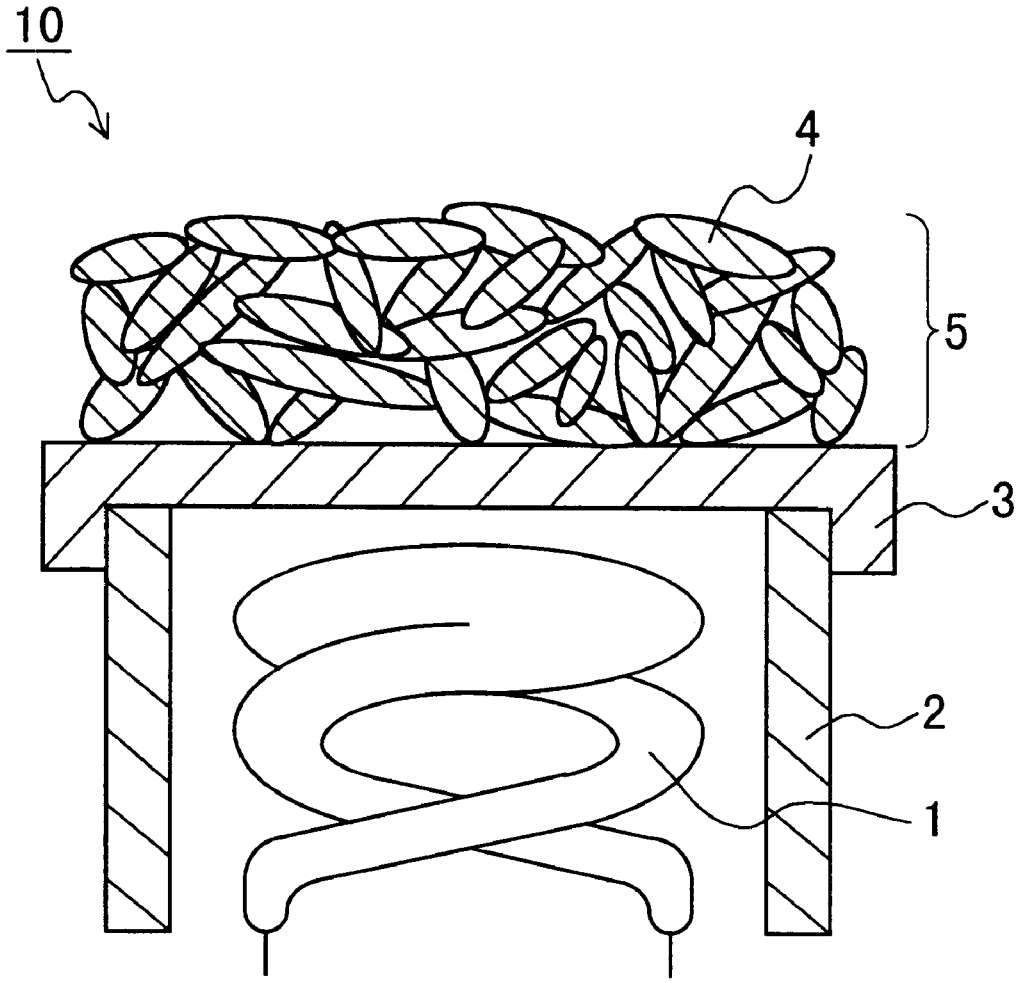
FIG. 1 is a partially sectional view showing a schematic configuration of an oxide cathode according to the present invention.

FIG. 1 shows a schematic configuration of a cathode of a cathode-ray tube according to the present invention. As illustrated in FIG. 1, an oxide cathode 10 includes a cylindrical sleeve 2 containing a heater coil 1, a cathode substrate 3 provided on one end of the sleeve 2, the cathode substrate 3 including nickel as a base and containing a reducing element such as magnesium, and an emissive material layer 5 adhered onto the cathode substrate 3 and comprised of alkaline earth metal oxide particles 4.

One example of a method for producing the emissive material layer of this cathode is described below.

Figure 2C:
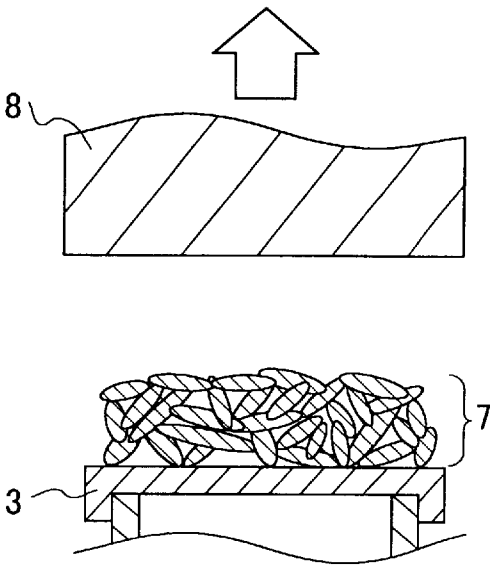
FIGS. 2A to 2C show a process of forming a carbonate layer in an oxide cathode according to the present invention.
Figure 2B:
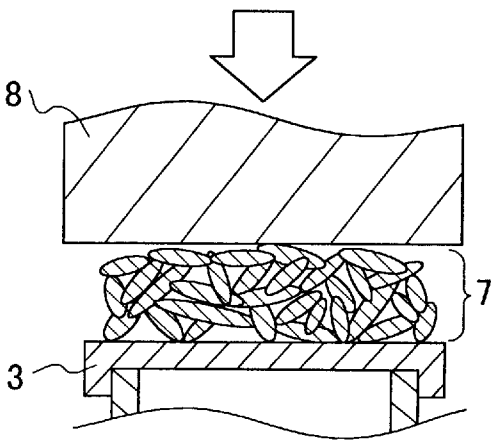
Figure 2A:
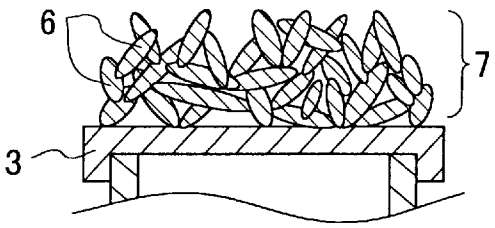

First, as illustrated in FIG. 2A, a binary carbonate 6 including barium and strontium at a molar ratio of 1:1 and having an average particle size of 3.5 $\mu$m and a maximum particle size of 10 $\mu$m was spray coated on a cathode substrate 3 with a spray gun to form a carbonate layer 7. Under this condition, the carbonate layer 7 had a bulk density of 0.6 g/cm$^3$, a thickness of 80 $\mu$m, and a surface roughness (a maximum height Rmax in accordance with the standard of JIS B 0601-1982) of 20 $\mu$m.

Then, as illustrated in FIG. 2B, the carbonate layer 7 was pressed from the top with a press die 8 having a flat face so that the carbonate layer 7 had a bulk density of 0.8 g/cm$^3$, a thickness of 60 $\mu$m, and a surface roughness of 12 $\mu$m. Specifically, it was press molded at a pressure of 3.0 kg/cm$^2$.

Then, after removing the press die 8 as in FIG. 2C, this cathode was mounted in a cathode-ray tube, and the carbonate layer 7 was thermally decomposed in vacuum of $1\times10^{-4}$ Pa (possible range of use is from $1\times10^{-2}$ Pa to $1\times10^{-6}$ Pa) at a temperature of 950° C. (possible range of use is from 900° C. to 1000° C.), thereby forming an emissive material layer composed of a binary oxide of barium and strontium having a bulk density of at least 0.45 g/cm$^3$ but not more than 0.7 g/cm$^3$.

The resulting emissive material layer had a flat surface and exhibited a porous structure having voids throughout the entire layer.

At this time, to investigate the current density distribution characteristic of the oxide cathode formed by the above method, a cathode image of a cathode-ray tube including this oxide cathode in an electron gun was evaluated.

The cathode image herein refers to a beam spot imaged on a screen by a cathode lens formed between a cathode and a control electrode under the condition in which the main lens of the electron gun is not effected. By watching the luminance distribution of this cathode image, the current density distribution of electrons emitted from the emissive material layer can be learned. When the luminance distribution of the cathode image is uniform, the current density distribution also is uniform.

The cathode image of a cathode-ray tube including the oxide cathode of this embodiment in which the electron emission surface is press molded exhibited a relatively uniform luminance distribution. On the other hand, the cathode image of a cathode-ray tube including an oxide cathode in which its electron emission surface is not press molded exhibited a luminance distribution in which bright and dark portions exist in patches.

In the oxide cathode of this embodiment, by pressing the carbonate layer to decrease the surface roughness of the emissive material layer, the luminance distribution can be made uniform, and thus the current density distribution of emission electrons can be made uniform. This results in excellent resolution, and a high-definition cathode-ray tube in which moire due to a scanning line is invisible can be realized. Furthermore, it is preferable that the emissive material layer has a maximum surface roughness of not more than 13 $\mu$m. Because the surface roughness of the carbonate layer and the surface roughness of the emissive material layer in the form of an oxide are approximately the same, it is preferable that the surface roughness of the carbonate layer also is not more than 13 $\mu$m.

Next, the life of the oxide cathode of this embodiment, the bulk density of the emissive material layer, and the pressing pressure are described.

Figure 3:
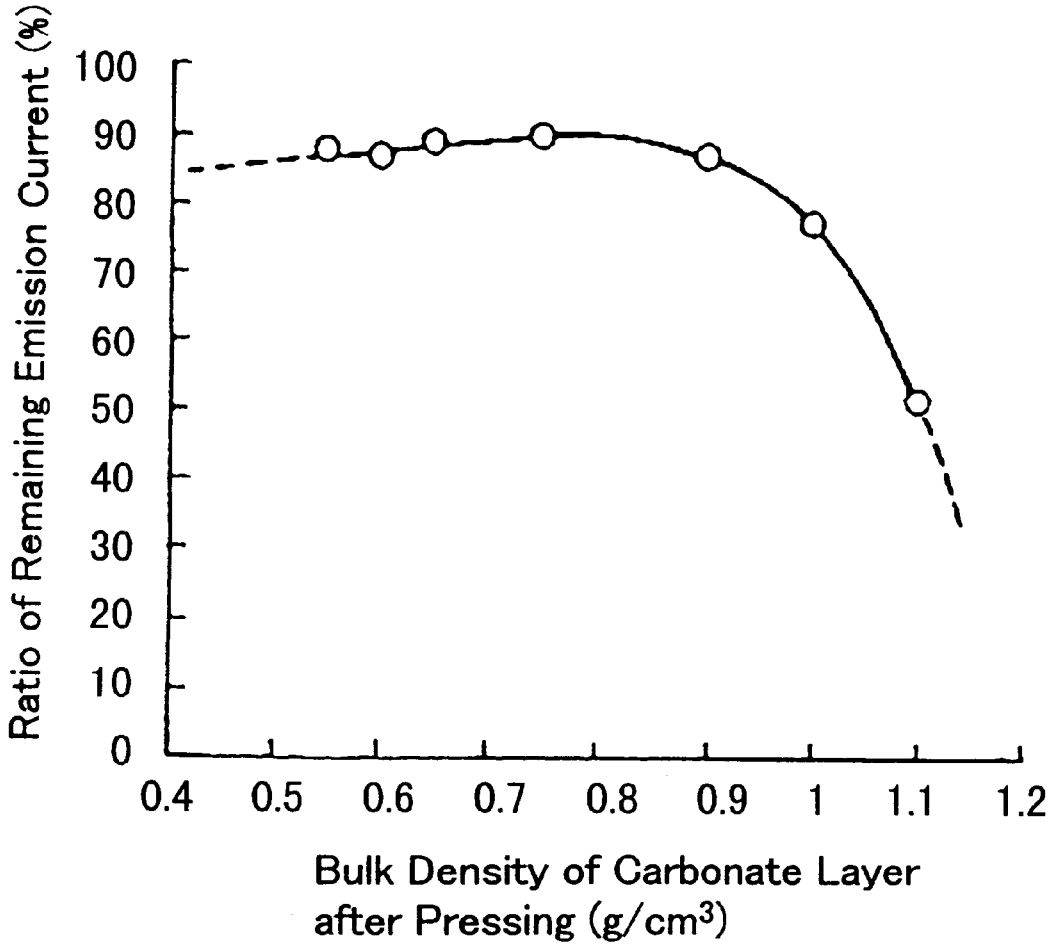
FIG. 3 shows a relationship between a bulk density of a carbonate layer after pressing and an emission current after carrying out an accelerated life test for 2000 hours.

FIG. 3 shows a relationship between the bulk density and the life of an oxide cathode having a pressed carbonate layer when a life test was carried out at a temperature of the emissive material layer of 850° C. with an emission current density of 2 A/cm$^2$. The relationship is the ratio of remaining emission current after being operated for 2000 hours versus the bulk density of the carbonate layer after pressing. The emission current at the initiation of the operation is considered as 100%. A higher ratio of remaining emission current, namely, a smaller decrease in emission current, means a longer life. The ratio of remaining emission current is preferably at least 80%.

As seen from FIG. 3, a decrease in the emission current becomes significantly large when the bulk density of the carbonate layer exceeds around 0.9 g/cm$^3$. This is because the porous structure of the emissive material layer is lost when the bulk density of the carbonate layer exceeds 0.9 g/cm$^3$. Thus, the bulk density of the carbonate layer after pressing is preferably not more than 0.9 g/cm$^3$. Accordingly, the porous structure of the emissive material layer can be maintained, and a decrease in the emission current can be inhibited, so that a high electron emission characteristic can be maintained over a long time.

Figure 4:
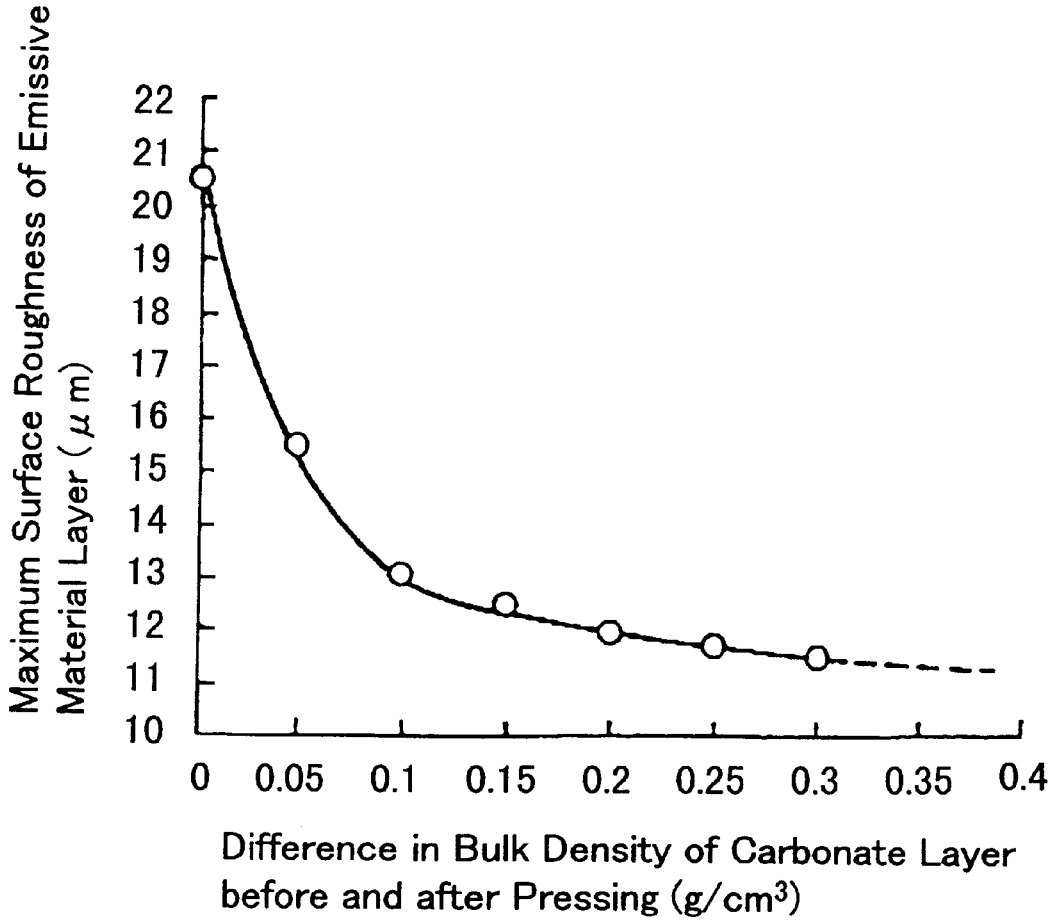
FIG. 4 shows a relationship between a difference in the bulk density of a carbonate layer before and after pressing and a surface roughness of an emissive material layer after pressing.

FIG. 4 shows a relationship of the surface roughness of the emissive material layer versus the difference in the bulk density of the carbonate layer before and after pressing.

To make the surface roughness of the emissive material layer be not more than 13 $\mu$m as described above, it is necessary that the difference in the bulk density of the carbonate layer before and after pressing is at least 0.1 g/cm$^3$. That is, to make the bulk density of the carbonate layer after pressing be not more than 0.9 g/cm$^3$ so as to maintain its porous structure, it is sufficient that the bulk density before pressing is not more than 0.8 g/cm$^3$.

However, when the bulk density before pressing is too low, the adhesion area between the carbonate particles and the substrate becomes small, resulting in a decrease in the adhesion strength of the carbonate layer to the substrate. This decrease in the adhesion strength causes peeling of the carbonate layer when a shock is applied to the cathode during and after pressing.

To eliminate distortion of the current density of emission electrons without causing peeling of the carbonate layer and to maintain a high electron emission characteristic over a long time, it is preferable that the bulk density of the carbonate before pressing is at least 0.5 g/cm$^3$ but not more than 0.8 g/cm$^3$, and the bulk density of the carbonate after pressing is at least 0.6 g/cm$^3$ but not more than 0.9 g/cm$^3$.

Figure 5:
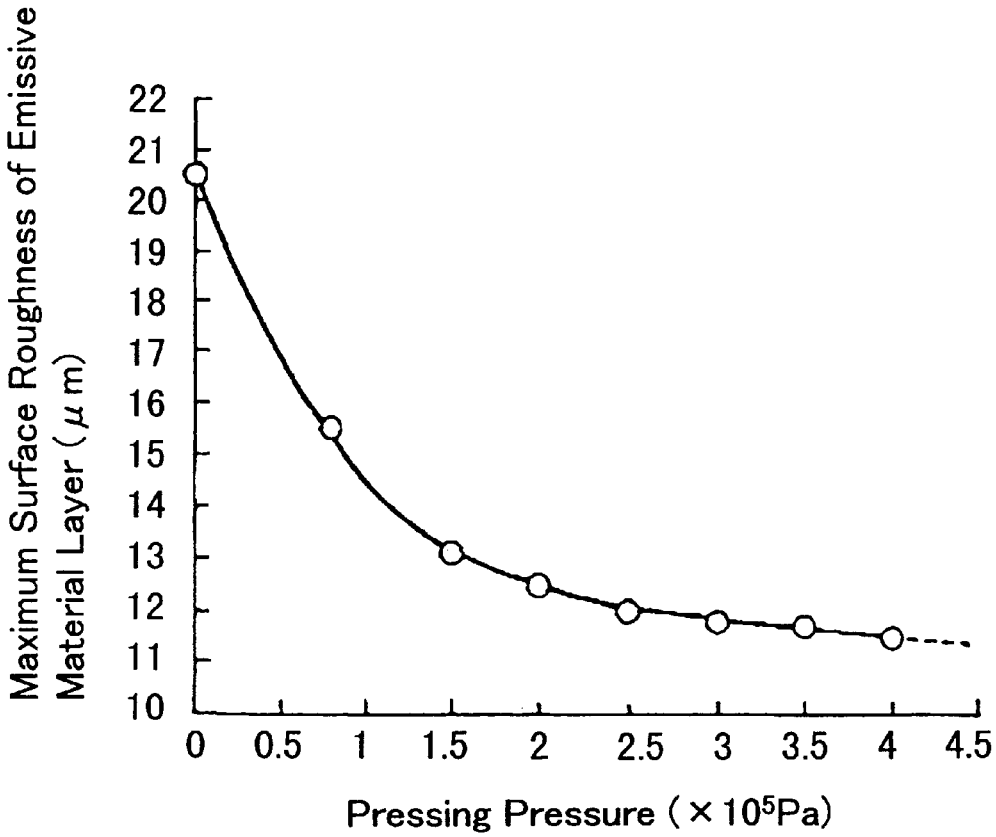
FIG. 5 shows a relationship between a pressing pressure and a surface roughness of an emissive material layer after pressing.

FIG. 5 shows the relationship of the surface roughness of the emissive material layer versus the pressing pressure. Because the surface roughness of the emissive material layer exceeds 13 $\mu$m when the pressing pressure is less than $1.5\times10^5$ Pa, it is preferable that the pressing pressure is at least $1.5\times10^5$ Pa.

Figure 6:
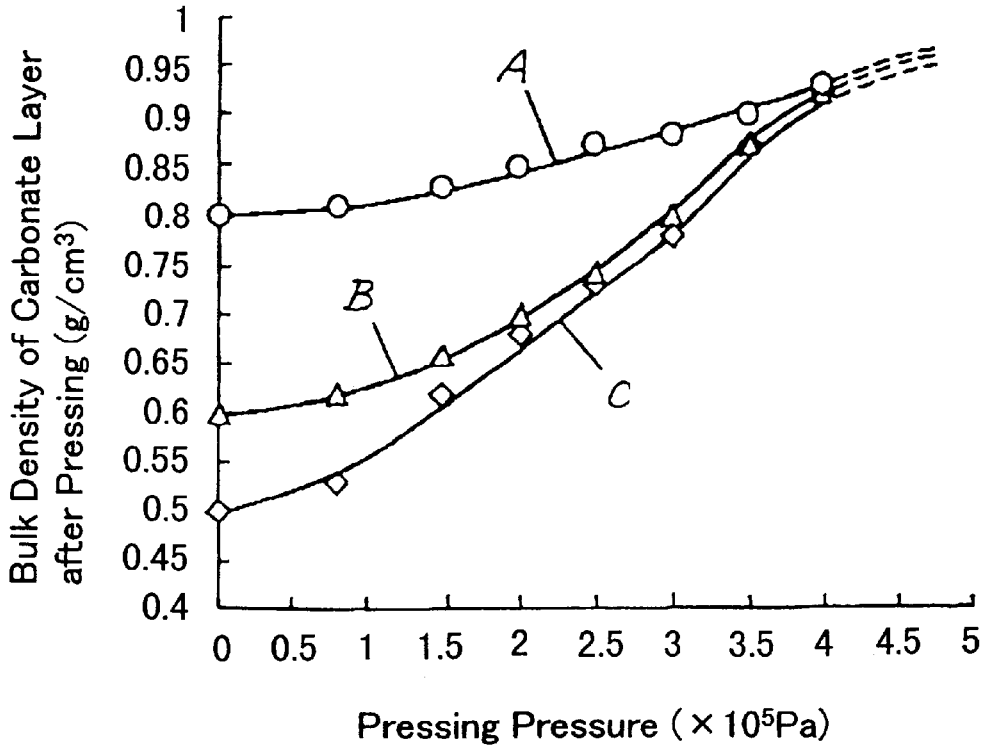
FIG. 6 shows a relationship between a pressing pressure and a bulk density of a carbonate layer after pressing.

FIG. 6 shows the relationship of the bulk density of the carbonate layer after pressing versus the pressing pressure. In this figure, a characteristic A is when the bulk density of the carbonate layer before pressing is 0.8 g/cm$^3$, a characteristic B is when the same is 0.6 g/cm$^3$, and a characteristic C is when the same is 0.5 g/cm$^3$. As seen from FIG. 6, in any of these cases, the bulk density of the carbonate layer comes to exceed 0.9 g/cm$^3$ when the pressing pressure exceeds around $3.5\times10^5$ Pa.

Thus, it is preferable that the pressure for pressing the carbonate layer is at least $1.5\times10^5$ Pa but not more than $3.5\times10^5$ Pa. Accordingly, its porous structure can be maintained, and distortion of the current density of emission electrons can be reduced.

Figure 7:
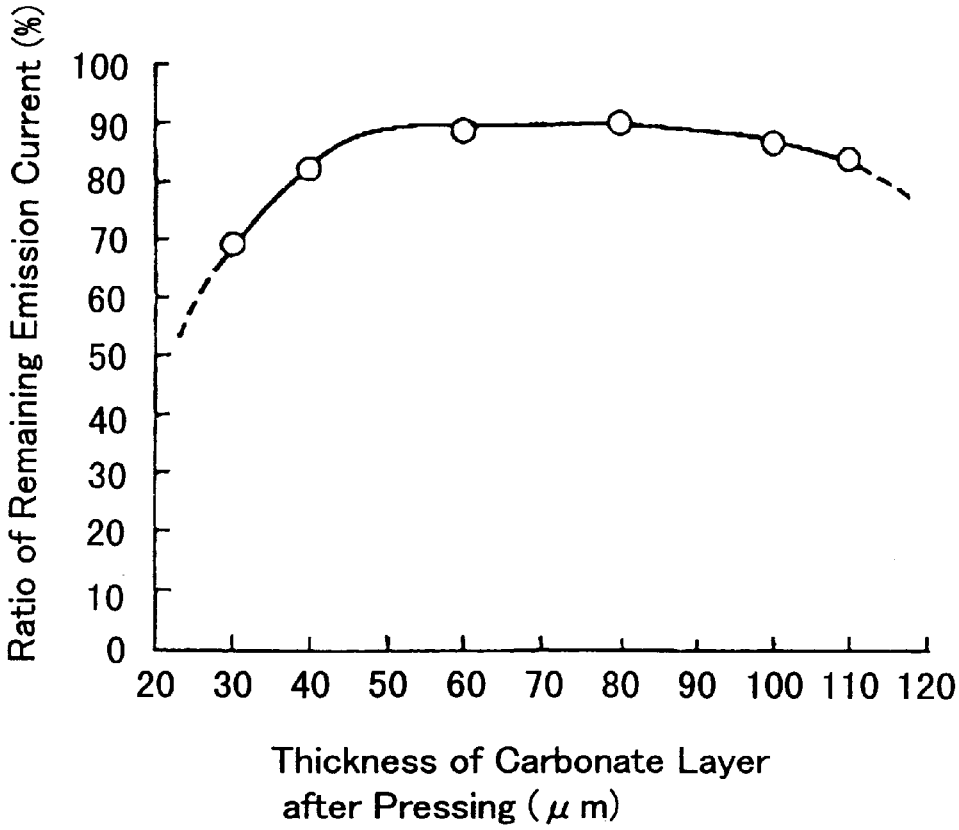
FIG. 7 shows a relationship between a thickness of a carbonate layer after pressing and an emission current after carrying out an accelerated life test for 2000 hours.
Figure 8:
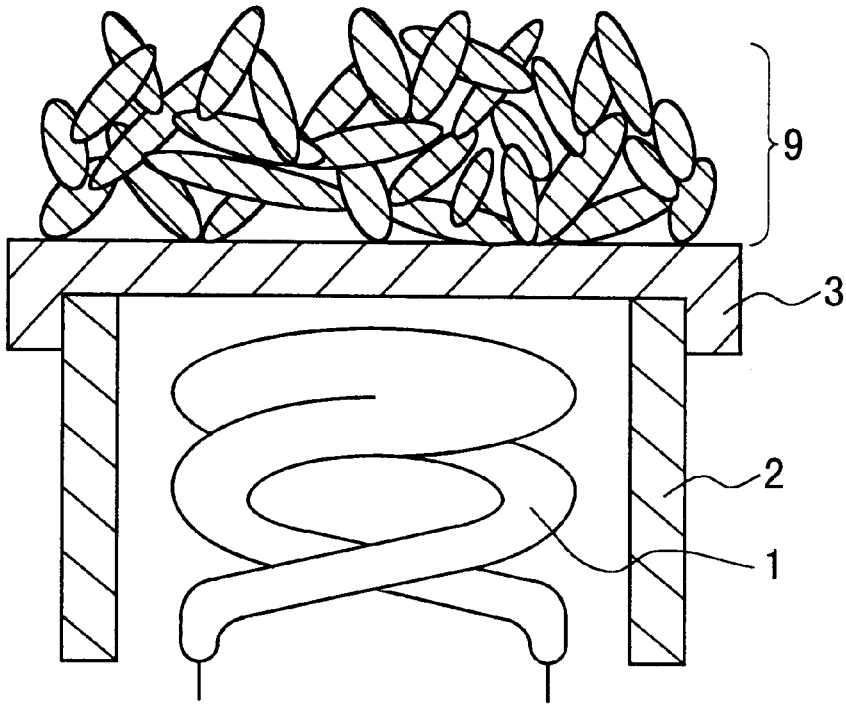
FIG . 8 (PRIOR ART)
FIG. 8 is a partially sectional view showing a schematic configuration of one example of a conventional oxide cathode.

FIG. 7 shows the relationship between the thickness and the life of a pressed carbonate layer in an oxide cathode. The relationship is the ratio of remaining emission current after being operated for 2000 hours versus the thickness of the carbonate layer after pressing. The emission current at the initiation of the operation is considered as 100%. A higher ratio of remaining emission current, namely, a smaller decrease in emission current, means a longer life.

As seen from FIG. 7, a decrease in the emission current is large when the thickness of the carbonate layer after pressing is less than 40 $\mu$m. Thus, taking the life into account, it is preferable that the thickness of the carbonate layer after pressing is more than 40 $\mu$m. However, if the carbonate layer after pressing is too thick, the adhesion strength of the carbonate layer to the substrate is decreased, so that peeling of the carbonate layer is caused easily when a shock is applied to the cathode. To prevent the carbonate layer from peeling while taking the life into account, it is preferable that the thickness of the carbonate layer after pressing is at least 40 $\mu$m but not more than 90 $\mu$m.

To maintain its porous structure, it is desirable that the average particle size of the carbonate is at least 2 $\mu$m. Furthermore, to make the surface roughness of the emissive material layer be not more than 13 $\mu$m, it is desirable that the maximum particle size is not more than 13 $\mu$m.

Although an example using a binary carbonate of barium and strontium as an alkaline earth metal carbonate has been described in this embodiment, this is no limiting, and any carbonate of an alkaline earth metal may be employed. For example, a ternary carbonate of barium, strontium and calcium may be used to form an alkaline earth metal carbonate.

Furthermore, although an example in which the entire surface of the carbonate layer is pressed to decrease the surface roughness of the emissive material layer has been described in this embodiment, the same effect is obtained when pressing only the portions facing the apertures of a grid electrode through which electron beams pass. In this case, it is sufficient that the bulk density of the carbonate layer is not more than 0.9 g/cm$^3$ at least in the pressed portions.

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A method for producing an oxide cathode comprising a sleeve containing a heater coil, a cathode substrate provided on one end of the sleeve, and an emissive material layer formed by thermally decomposing an alkaline earth metal carbonate layer adhered onto the cathode substrate, which method comprises:

adhering the alkaline earth metal carbonate onto the cathode substrate so that the alkaline earth metal carbonate has a bulk density of at least 0.5 g/cm$^3$ but not more than 0.8 g/cm$^3$;

then pressing the alkaline earth metal carbonate so that the bulk density becomes not more than 0.9 g/cm$^3$, thereby forming the carbonate layer; and then thermally decomposing the carbonate layer in vacuum.

2. The method according to claim 1, wherein a pressure of the pressing is at least $1.5\times10^5$ Pa but not more than $3.5\times10^5$ Pa.

3. The method according to claim 1, wherein a thickness of the carbonate layer after the pressing is at least 40 $\mu$m but not more than 90 $\mu$m.

4. The method according to claim 1, wherein a surface roughness of the carbonate layer after the pressing is not more than 13 $\mu$m.

5. The method according to claim 1, wherein the alkaline earth metal carbonate has an average particle size of at least 2 $\mu$m and a maximum particle size of not more than 13 $\mu$m.

6. The method according to claim 1, wherein a bulk density of the carbonate layer after the pressing is at least 0.6 g/cm$^3$ but not more than 0.9 g/cm$^3$.

7. The method according to claim 1, wherein the thermal decomposition is carried out at a temperature of 900 to 1000° C.

8. The method according to claim 1, wherein the thermal decomposition is carried out at a pressure of $1\times10^{-6}$ to $1\times10^{-2}$ Pa.

9. The method according to claim 1, wherein in an obtained oxide cathode, a ratio of remaining emission current after being operated for 2000 hours at a temperature of the emissive material layer of 850° C. with an emission current density of 2 A/cm$^2$ is at least 80%, when considering an initial value as 100%.

10. The method according to claim 1, wherein the alkaline earth metal carbonate is a binary carbonate of barium and strontium or a ternary carbonate of barium, strontium and calcium.

* * * * *